US006952076B2

(12) United States Patent
Li et al.

(10) Patent No.: US 6,952,076 B2
(45) Date of Patent: Oct. 4, 2005

(54) LEAD FREE BASE LOCKING MECHANISM

(75) Inventors: Jianwu Li, Solon, OH (US); Bradley R. Karas, Twinsburg, OH (US)

(73) Assignee: General Electric Company, Schenectady, NY (US)

( * ) Notice: Subject to any disclaimer, the term of this patent is extended or adjusted under 35 U.S.C. 154(b) by 113 days.

(21) Appl. No.: 10/677,768

(22) Filed: Oct. 2, 2003

(65) Prior Publication Data

US 2004/0070983 A1 Apr. 15, 2004

Related U.S. Application Data

(63) Continuation of application No. 09/606,387, filed on Jun. 29, 2000, now abandoned.

(51) Int. Cl.[7] ..... H01J 5/48

(52) U.S. Cl. ..... 313/318.09; 313/318.04; 313/318.1; 313/318.01; 445/27

(58) Field of Search ..... 313/318.01, 318.03, 313/318.04, 318.05, 318.1, 318.09, 51; 439/611, 615; 445/27

(56) References Cited

U.S. PATENT DOCUMENTS 1,049,070 A * 12/1912 Fowler ..... 403/24
2,142,072 A * 12/1938 Heinrich et al. ..... 439/615
5,521,460 A * 5/1996 Zhu ..... 313/318.09

* cited by examiner

*Primary Examiner*—Vip Patel
*Assistant Examiner*—Anthony Perry
(74) *Attorney, Agent, or Firm*—Fay, Sharpe, Fagan, Minnich & McKee, LLP

(57) ABSTRACT

A lamp that utilizes a lamp base locking ring to secure a lamp base shell to a lamp. A hollow light transmitting body terminates in a neck that includes threads and a keyway. A lamp base locking ring having an indentation that extends into to the keyway is disposed around the circumference of the neck. A lamp base shell is threaded onto the threads of the neck. The lamp base shell is mechanically fastened to the lamp base locking to secure the lamp base shell to hollow light transmitting body.

17 Claims, 3 Drawing Sheets

16
A
12
32a
28b
26
34a
34b
28a
24b
24a
20
18
19
10
22
14
A 42
24b
24a
16
46
34b
34a
10
36
22
14
A 42
16
46
24a
10
22
14
A

LEAD FREE BASE LOCKING MECHANISM

This application is a continuation application of Ser. No. 09/606,387 filed on Jun. 29, 2000, now abandoned.

TECHNICAL FIELD

The present invention relates generally to lamps, and in particular, to a lamp that utilizes a lamp base locking ring to secure a lamp base shell to the lamp.

BACKGROUND ART

It is common in the art to use lamp base shells to facilitate insertion and removal of a lamp into a corresponding lamp socket to establish electrical contact between the conductors of the lamp and the socket. Several structures have been developed to prevent the lamp base shell from being separated from the lamp base. See, for example, U.S. Pat. Nos. 1,262,936; 2,028,884; 2,157,051 and 5,006,751.

One method of securing a lamp base shell to a lamp utilizes a threaded inner shell having a washer-like base and a plurality of orthogonally projecting tabs around the periphery of the base to secure the lamp base shell to the lamp. The tabs of the inner shell each have a dimple that corresponds with an indentation in the neck of the lamp. The inner shell is secured to the lamp base by placing it over the neck until the corresponding dimples and indentations are aligned. Once the inner shell is in place, a lamp based shell is securely screwed onto the inner shell and is staked to engage it with the inner shell. This configuration requires expensive parts and involves difficult assembly.

Another method used to mechanically secure a base shell to a lamp employs a threaded form molded into the lamp glass with a keyway to accommodate a lead solder preform that is used to make an electrical connection to one of the lamp leads and to lock the base onto the lamp. Although this method provides sufficient back out torque resistance and addresses deficiencies of the inner shell technique, the use of lead solder has several disadvantages. Environmental laws and regulations continue to impose increasingly stringent standards that force the lamp industry to phase-out use of lead solder. Additionally, lead solder discolors the base shells of the lamps.

U.S. Pat. Nos. 5,381,070 (>070 patent) and 5,521,460 (>460 patent) disclose lamp base locking clips. The lamp base locking clip of the >070 patent includes a plate having a lip that extends outward on one end and has a flat portion on the opposite end. The locking clip is captured in a keyway formed on the glass neck of the lamp body. One of the lamp lead wires is welded to the flat portion of the clip and a rim on the lamp base shell is welded to the outwardly extending lip of the locking clip to form a lamp base assembly that does not include lead based solder.

The lamp base locking clip of the >460 patent has first and second ends of a given thickness and an intermediate portion that is at least approximately three times the thickness of the first and second ends. The lamp base locking clip is positioned in a keyway and connected to one lead in wire and the lamp base shell to secure the lamp base shell.

DISCLOSURE OF INVENTION

The present invention concerns a lamp. The lamp includes a hollow light transmitting body, a lamp base locking ring and the lamp base shell. The hollow light transmitting body includes a light source that includes first and second leads that extend from a neck of the hollow light transmitting body. The body terminates in the neck that is substantially circular in cross-section. The neck includes a keyway formed in the neck that is parallel to the neck=s longitudinal axis and includes external threads about the circumference of the neck. The lamp base locking ring is disposed around the circumference of the neck. The locking ring includes an indentation that extends inward from an outer diameter of the locking ring. The indentation fits into the keyway in the neck that inhibits rotative movement of the locking ring about the neck. The lamp base shell has internal threads that are threaded onto external threads of the neck. The lamp base shell is mechanically fastened to the lamp base locking ring to inhibit movement of the lamp base shell with respect to the neck. The lamp base shell includes first and second electrically conductive portions that are electrically connected to corresponding first and second leads of the light source.

The locking ring may include one or more projections extending from it for fastening the locking ring to the lamp base shell. The one or more projections of the lamp base locking ring allow the lamp base locking ring to be assembled to the lamp base shell before the lamp base shell and the lamp base locking ring are assembled to the lamp. In this embodiment, the locking ring is rotatively connected to the lamp base shell. The lamp base assembly including the lamp base ring may be threaded onto threads of the neck, because of the rotative freedom of the locking ring with respect to the lamp base shell.

A lamp of the present invention is fabricated by inserting the neck of a lamp body into a locking ring, such that a locking ring indentation extends into a keyway. The internal threads of the lamp base shell are threaded onto the threads of the lamp neck. The locking ring is mechanically fastened to the lamp base shell to inhibit movement of the lamp base shell with respect to the neck. The fastening of the locking ring to the lamp base shell may be accomplished by spot welding, resistance welding or plasma welding. When the locking ring includes a projection, it may be bent over an open end of the lamp base shell to ease connection of the locking ring to the base shell. Also, when the locking ring includes one or more projections, the locking ring and lamp base shell may be assembled prior to being assembled to the lamp, such that the lamp base shell and the locking ring can rotate with respect to one another.

A lamp constructed in accordance with the present invention eliminates the need for lead solder to secure the lamp base shell to the lamp. Additionally, the use of a locking ring eases assembly of the lamp base shell to the lamp, because the movement of the locking ring with respect to the lamp base shell is limited by the keyway as the lamp base shell is threaded onto the threads of the neck.

Additional features of the invention will become apparent and a fuller understanding obtained by reading the following detailed description in connection with the accompanying drawings.

BEST MODE FOR CARRYING OUT THE INVENTION

Figures 1A, 1B, 1C:
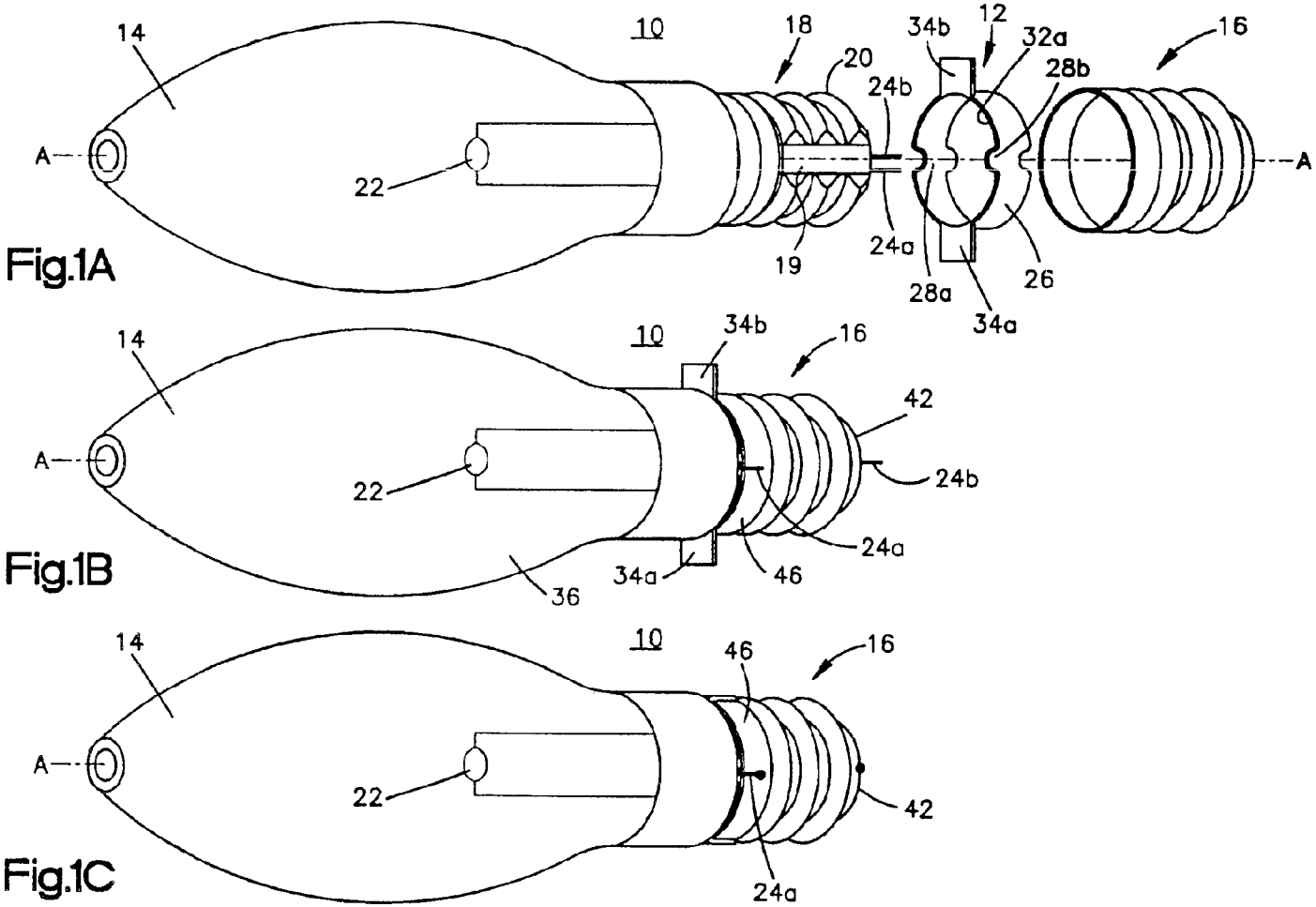
FIG. 1A is a perspective view of a hollow light transmitting body, a lamp base locking ring and a lamp base shell.
FIG. 1B is a perspective view of a hollow light transmitting body, with a lamp base locking ring and a lamp base shell disposed around a neck of the hollow light transmitting body.
FIG. 1C is a perspective view of a lamp constructed in accordance with the present invention.
Figure 6:
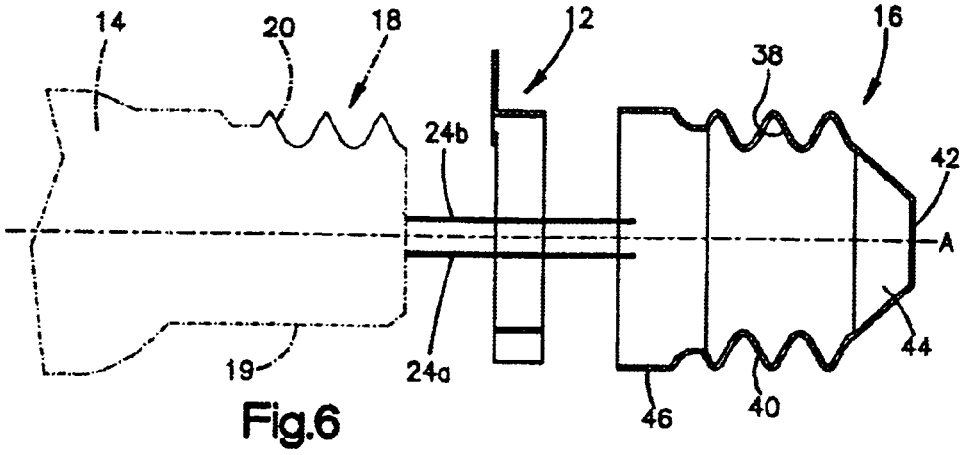
FIG. 6 is an exploded sectional view taken across line 3—3 of FIG. 2 of a lamp base locking ring and a lamp base shell being assembled to a hollow light transmitting body.

The present invention is directed to a lamp 10 which utilizes a lamp base locking ring 12 to connect a hollow light transmitting body 14 to a lamp base shell 16. The hollow light transmitting body 14 or bulb terminates in a neck 18. The neck is substantially circular in cross-section and has a longitudinal axis A and a circumference. Referring to FIG. 1A, the neck includes a plurality of external threads 20 for attachment of the lamp base shell 16 and two keyways 19 (only one of these keyways is visible in FIG. 1A) that extend along opposite sides of the neck 18 formed in the neck parallel to the axis A. The hollow light transmitting body 14 includes a light source 22 and first and second leads 24*a*, 24*b*. The light source 22 may be any type of light source. For example, the light source may be a filament, a filament tube or an arc tube. Referring to FIGS. 1A and 6, the leads 24*a*, 24*b* extend from the neck 18 of the lamp 10 along axis A before the lamp base shell 16 and lamp base locking ring 12 are assembled to the neck 18. Initial placement of such leads is well known in the prior art.

Figure 2:
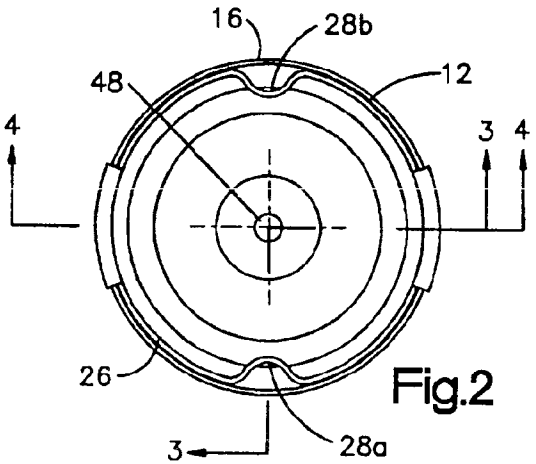
FIG. 2 is a top plan view of a lamp base locking ring rotatively connected to a lamp base shell.

Referring to FIGS. 1A and 2, the lamp base locking ring 12 of the exemplary embodiment is made from a band of material that is formed into a circular ring 26. In the exemplary embodiment, two indentations 28*a*, 28*b* extend inward from the outer diameter of the circular ring 26. The indentations 28*a*, 28*b* correspond to the keyways 19 in the neck 18 of the hollow light transmitting body 14. Extending from a first end 32*a* of the circular ring portion 26 are two projections 34*a*, 34*b* that extend radially outward from the circular ring portion 26 before the lamp base locking ring 12 is assembled to the lamp base shell 16. In the exemplary embodiment, the indentations 28*a*, 28*b* are diametrically opposed. The projections 34*a*, 34*b* are also diametrically opposed and are at an angle of approximately 90E from the first and second indentations 28*a*, 28*b*. The lamp base locking ring 12 of the present invention can be made from virtually any material. For example, the lamp base locking ring 12 may be made from copper, brass, nickel, steel or stainless steel.

Figure 7:
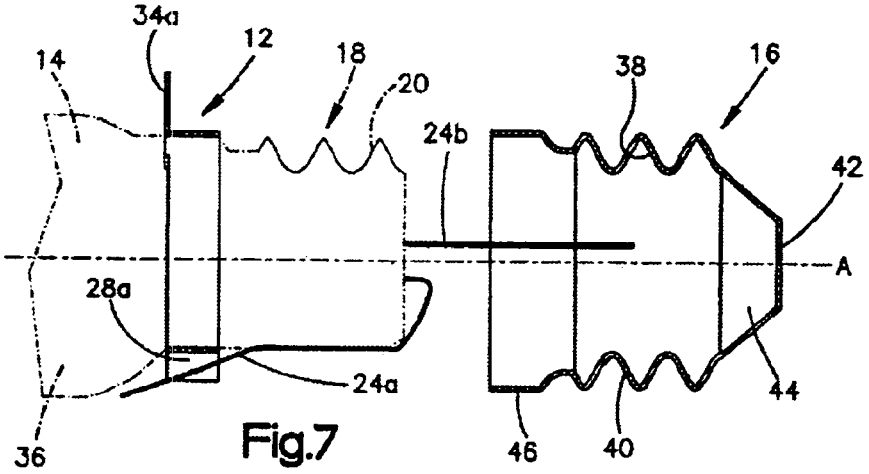
FIG. 7 is an exploded sectional view taken across line 3—3 of FIG. 2 of a lamp base locking ring and a lamp base shell being assembled to a hollow light transmitting body; and, FIG. 8 is a sectional view taken across line 3—3 of FIG. 2 of a lamp base locking ring and a lamp base shell assembled to a hollow light transmitting body.

Referring to FIGS. 1A, 6 and 7, to assemble the locking ring 12 to the hollow light transmitting body, the indentations 28*a*, 28*b* are aligned with the keyways 19 in the neck 18. The neck 18 and leads 24*a*, 24*b* are inserted through the lamp base locking ring 12. Referring to FIGS. 1B and 7, the lead 24*a* is bent so that it extends through the keyway 19 toward a light emitting end 36 of the hollow light transmitting body 14 past the indentation 28*a* of the lamp base locking ring 12. The lamp base locking ring may be used with many different hollow light transmitting bodies or bulbs. The present invention can be used with virtually any type of hollow light transmitting body or bulb. Examples of acceptable hollow light transmitting bodies or bulbs are Model Numbers ED 18, ED28 and ED37 sold by General Electric Company, assignee of the present invention.

Referring to FIG. 7, the lamp base shell 16 has internal threads 38 that correspond with the external threads 20 on the neck 18 of the hollow light transmitting body 14. In the exemplary embodiment, the lamp base shell 16 comprises a threaded conductive portion 40 that is connected to a conductive end portion 42 by an insulating portion 44. The threads 38 of the lamp base shell 16 extend to a generally cylindrical portion 46 of the lamp base shell 16. The conductive end portion 42 includes a hole 48 (shown in FIG. 2) for the lead 24*b*. The threads 38 of the lamp base shell 16 are threaded onto the external threads 20 on the neck 18 of the hollow light transmitting body 14. The diameter of the cylindrical portion 46 of the lamp base shell 16 of the exemplary embodiment is slightly larger than typical lamp base shells, leaving room for the locking ring 12. In an alternate embodiment, the diameter of the cylindrical portion of the lamp base shell 16 is the same as typical lamp base shells and the neck of the bulb is slightly smaller than typical bulbs, leaving room for the locking ring 12. Examples of lamp base shells that may be used or modified in accordance with the present invention are Model Numbers Mog Screw E26, Mog Screw E27 and Mog Screw E39 sold by The General Electric Company, assignee of the present invention.

Figure 8:
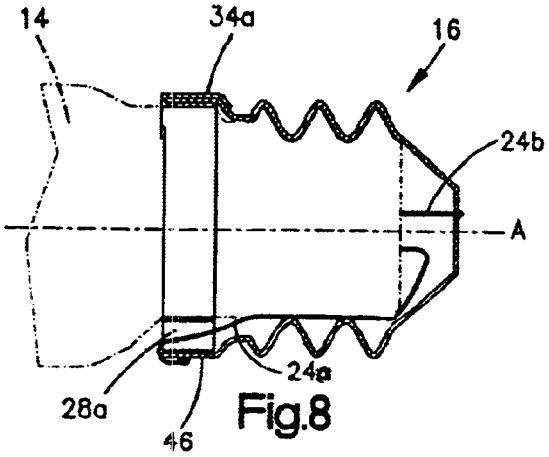

Referring to FIGS. 1B, 1C and 8, lead 24*a* extends in a keyway 19 towards the light emitting end 36 of the hollow light transmitting body past an indentation 28*a* of the lamp locking ring 12 and out of the lamp base shell 16. The lead 24*b* extends from the neck 18 of the hollow light transmitting body 14 and through the hole 48 in the conductive end portion 42 of the lamp base shell 16.

Referring to FIGS. 1B, 1C and 8, once the lamp base locking ring 12 and lamp base shell 16 are assembled to the neck 18 of the hollow light transmitting body 14, the projections 34*a*, 34*b* and lead 24*a* are bent down against the generally cylindrical portion 46 of the lamp base shell 16 and welded to the lamp base shell. The indentations 28*a*, 28*b* extending inward from the outer diameter of the lamp base locking ring 12 inhibit rotative movement of the connected lamp base locking ring 12 and the lamp base shell 16 to prevent the threads 38 of the lamp base shell 16 from being disengaged from the threads 20 of the neck 18 of the hollow light transmitting body 14. In one embodiment, the lamp base shell 16 is spot welded to the lamp base locking ring 12. In the second embodiment, the projections 34*a*, 34*b* are resistance welded to the lamp base shell 16. Other connection techniques such as plasma welding may also be employed to connect the projections to the lamp base shell.

Referring to FIGS. 1C and 8, lead 24*a* is welded to the generally cylindrical portion 46 of the lamp base shell 16 and lead 24*b* is welded to the conductive end portion 42 to electrically connect the light source 22 to the threaded conductive portion and conductive end portion of the lamp base shell 16. The leads 24*a*, 24*b* may be spot welded, resistance welded or plasma welded to the base shell 16.

Figure 3:
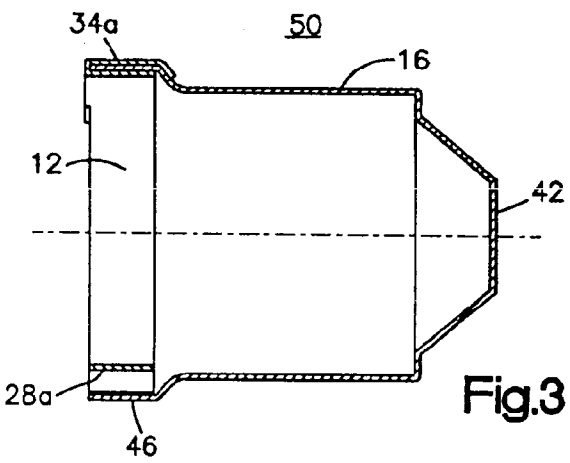
FIG. 3 is a sectional view taken across line 3—3 of FIG. 2.
Figure 5:
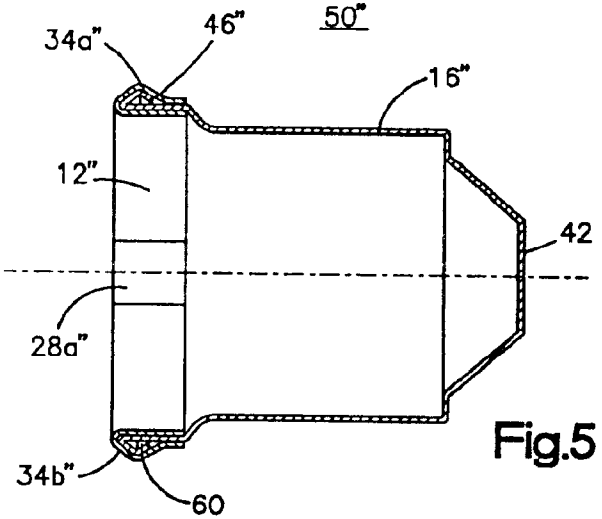
FIG. 5 is a sectional view of a lamp base locking ring and lamp base shell assembly of an alternate embodiment taken across line 4—4 of FIG. 2.
Figure 4:
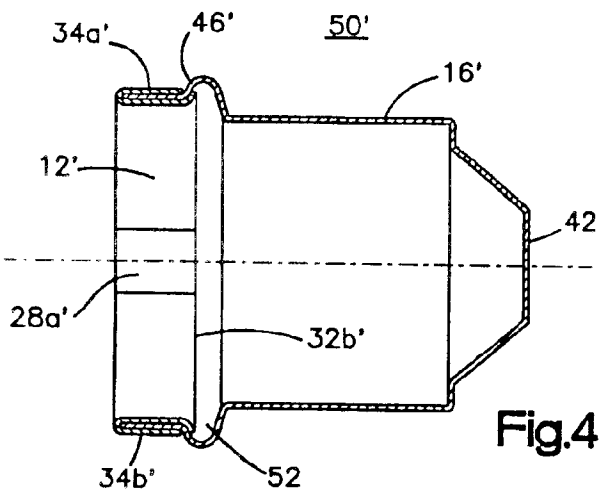
FIG. 4 is a sectional view of a lamp base locking ring and lamp base shell assembly of an alternate embodiment taken across line 4—4 of FIG. 2.

In alternate embodiments that are shown in FIGS. 3, 4 and 5, the lamp base locking ring 12 is rotatively connected to the lamp base shell 16 (shown without internal and external threads to simplify the drawing) prior to being installed on the hollow light transmitting body 14 to ease assembly.

In the embodiment shown in FIG. 3, the lamp base locking ring 12 is rotatively connected to the lamp base shell 16 by loosely crimping the projections 34*a*, 34*b* (34*b* not shown) around a generally cylindrical portion 46 of the lamp base shell 16, allowing rotative movement between the lamp base shell 16 and the lamp base locking ring 12.

In the embodiment shown in FIG. 4, the lamp base shell 16' includes a flared out portion 52 around the circumference of the cylindrical portion 46'. The lamp base locking ring 12' is inserted into the generally cylindrical portion 46' of the lamp base shell 16'. The end 32*b'* of the lamp base locking ring 12' is flared into the flared out portion 52 of the lamp base shell 16' and the projections 34*a'*, 34*b'* of the lamp base locking ring 12' are bent down around the generally cylindrical portion 46' of the lamp base shell 16' to rotatively fasten the lamp base locking ring 12' to the lamp base shell 16'.

In the embodiment shown in FIG. 5, the cylindrical portion 46" is folded back on itself to form a ridge 60 around the circumference of the cylindrical portion 46" of the lamp base shell 16". The projections 34*a"*, 34*b"* of the lamp base locking ring 12" are loosely crimped over the ridge 60 formed on the cylindrical portion 46" of the lamp base shell 16" to rotatively connect the lamp base locking ring 12" to the lamp base shell 16".

In each of the embodiments shown in FIGS. 3, 4 and 5, the lamp base locking ring 12 is permitted to rotate with respect to the lamp base shell 16, but is prevented from being removed from the generally cylindrical portion 46 of the lamp base shell 16.

The lamp base locking ring and lamp base shell assembly 50, of any of the embodiments shown are assembled to the neck 18 of the hollow light transmitting body 14 by first bending lead 24*a* in a keyway 19 of the neck 18 of the hollow light transmitting body 14. The neck 18 may include a separate keyway 19 for the lead 24*a* or a keyway 19 may be large enough for an indentation 28*a*, 28*b* of the locking ring to be disposed next to the lead 24*a* in the keyway 19. The one or more indentations 28*a*, 28*b* of the lamp locking ring 12 are aligned with the one or more corresponding keyways 19 (shown in FIGS. 1A and 6) in the neck 18. The lamp base locking ring and shell assembly 50 is brought into engagement with the threads 20 on the neck 18, while maintaining alignment of the indentations 28*a*, 28*b* with the keyways 19. The lamp base shell 16 is rotated about the neck 18 to move the lamp base locking ring 12 of the lamp base locking ring and shell assembly 50 in the keyways 19 in the neck 18. As the lamp base shell 16 is rotated, the movement of the indentations 28*a*, 28*b* is constrained by the keyways 19 in the neck 18. The rotation of the lamp base shell 16 is continued until the lamp base locking ring and shell assembly 50 is tightly attached to the neck 18 of the hollow light transmitting body 14. Lead 24*a* extends from the lamp base locking ring and shell assembly 50 and lead 24*b* extends through the conductive end portion 42 of the lamp base locking ring and shell assembly 50. In each of the embodiments shown in FIGS. 3, 4 and 5, the lamp base locking ring 12 includes projections 34*a*, 34*b* that are welded to the lamp base shell 16 to prevent rotative motion between the lamp base shell 16 and the lamp base locking ring 12 to lock the lamp base locking ring and shell assembly to the hollow light transmitting body. The lead 24*a* is welded to the lamp base shell and lead 24*b* is welded to the conductive end portion 42 of the lamp base shell 16 of the lamp base assembly 50.

Although the present invention has been described with a degree of particularity, it is the intent that the invention include all modifications and alterations falling within the spirit or scope of the appended claims.

We claim:

1. A lamp, comprising:

a) a hollow light transmitting body including a light source, said body terminating in a neck, said neck being substantially circular in cross-section and having a longitudinal axis and a circumference, said neck including a keyway formed in said neck parallel to said axis and external threads about said circumference, said light transmitting body comprising first and second leads extending from the neck of said body;

b) a lamp base locking ring disposed around said circumference of said neck, said locking ring including an indentation extending inward from an outer diameter of said locking ring that fits into said keyway for inhibiting rotative movement of said locking ring about said neck;

c) a lamp base shell having internal threads in communication with said external threads of said neck, said lamp base shell mechanically fastened to said lamp base locking ring to inhibit movement of said lamp base shell with respect to said neck, said lamp base shell having first and second electrically conductive portions, said first lead being electrically connected to said first electrically conductive portion of said shell, said second lead being electrically connected to said second electrically conductive portion of said shell; and d) a projection extending from said locking ring for mechanically fastening said locking ring to said lamp base shell.

2. The lamp of claim 1 wherein said lamp base shell is electrically connected to said lamp base locking ring.

3. The lamp of claim 1 wherein said lamp base shell is welded to said lamp base locking ring.

4. The lamp of claim 1 wherein said projection is resistance welded to said lamp base shell.

5. The lamp of claim 1 wherein said lamp base shell is spot-welded to said lamp base locking ring.

6. The lamp of claim 1 wherein said lamp base shell is plasma welded to said lamp base locking ring.

7. The lamp of claim 1 wherein said lamp base shell is brazed to said lamp base locking ring.

8. The lamp of claim 1 wherein said lamp base shell is soldered to said base lamp locking ring.

9. A lamp base shell apparatus for a lamp having first and second leads and a neck having threads and a keyway, comprising:

a) a lamp base shell including internal threads for engagement of said threads of said neck, said lamp base shell having first and second electrically conductive portions for connection of said first and second leads;

b) a locking ring rotatively connected to said lamp base shell, said locking ring being sized to fit around said neck, said locking ring including an indentation extending inward from an outer diameter of said locking ring adapted to fit in said keyway to inhibit rotative movement of said locking ring about said neck; and c) a projection extending from said locking ring for mechanically fastening said locking ring to said lamp base shell.

10. A method of securing a lamp base shell to a lamp comprising:

a) inserting a neck of said lamp having threads and a keyway into a locking ring having an indentation that corresponds with said keyway;

b) threading internal threads of said lamp base shell onto said threads of said neck;

c) mechanically fastening said locking ring to said lamp base shell to inhibit movement of said lamp base shell with respect to said neck; and d) bending a projection of said locking ring over an open end of said lamp base shell and connecting said projection to said lamp base shell.

11. The method of claim 10 further comprising electrically connecting first and second leads of said lamp to first and second electrically conductive portions of said lamp base shell.

12. The method of claim 10 wherein said locking ring is spot-welded to said lamp base shell.

13. The method of claim 10 wherein said locking ring is resistance welded to said lamp base shell.

14. The method of claim 10 wherein said locking ring and said lamp base shell are assembled prior to assembly to said lamp.

15. The method of claim 10 wherein the assembly of said locking ring to said lamp base shell prior to assembly of the lamp allows rotation of said locking ring with respect to said lamp base shell.

16. A lamp base shell apparatus for a lamp having a neck including threads and a keyway, comprising:

a) an electrically conductive lamp base shell including internal threads for engagement of said threads of said neck; and, b) a locking ring rotatively connected to said lamp base shell, said locking ring being sized to fit around said neck, said locking ring including an indentation extending inward from an outer diameter of said locking ring adapted to fit in said keyway to inhibit rotative movement of said locking ring about said neck.

17. A lamp base shell apparatus for a lamp having a neck including threads, comprising:

a) an electrically conductive lamp base shell including internal threads for engagement of said threads of said neck;

b) a locking ring rotatively connected to said lamp base shell, said locking ring being sized to fit around said neck; and, c) a projection extending from said locking ring for mechanically fastening said locking ring to said lamp base shell.

* * * * *